United States Patent [19]

Ouchi et al.

[11] 4,184,898

[45] Jan. 22, 1980

[54] METHOD OF MANUFACTURING HIGH STRENGTH LOW ALLOYS STEEL PLATES WITH SUPERIOR LOW TEMPERATURE TOUGHNESS

[75] Inventors: Chiaki Ouchi; Tomoyoshi Okita; Kazuaki Matsumoto, all of Yokohama, Japan

[73] Assignee: Nippon Kokan Kabushiki Kaisha, Tokyo, Japan

[21] Appl. No.: 923,500

[22] Filed: Jul. 11, 1978

[30] Foreign Application Priority Data

Jul. 20, 1977 [JP] Japan ..... 52-85980

[51] Int. Cl.[2] ..... C21D 1/20

[52] U.S. Cl. ..... 148/12 F; 148/12.4; 148/36

[58] Field of Search ..... 148/12 R, 12 F, 12.4, 148/36

[56] References Cited

U.S. PATENT DOCUMENTS

| | | | |
|---|---|---|---|
| 3,787,250 | 1/1974 | Korchynsky et al. | 148/12 F |
| 3,860,456 | 1/1975 | Repas | 148/12 F |
| 4,092,179 | 5/1978 | Charpentier et al. | 148/12 F |

*Primary Examiner*—W. Stallard

*Attorney, Agent, or Firm*—Frishauf, Holtz, Goodman & Woodward

[57] ABSTRACT

A steel slab or bloom containing 0.3~0.15% by weight of C, 0.05~0.60% by weight of Si, 0.60~2.5% by weight of Mn, 0.010~0.15% by weight of Nb, 0.005~0.10% by weight of soluble Al and the remainder of iron is heated to such a temperature region above 1050° C. and below the reheating temperature where the austenitic grain size would be 150μ. The heated slab or bloom is then hot rolled with total rolling reduction of more than 40% with respect to a finished thickness at the non-recrystallized austenitic region and the hot rolled stocks are subjected to accelerated cooling at a rate of 5°~20° C./sec. from a temperature higher than the $Ar_3$ transformation point to a temperature within 550°~650° C. Finally the stocks are air cooled.

7 Claims, 6 Drawing Figures sample A
sample B
sample C
ΔvTs (accelerated cooling − as rolled (°C))
ΔYS, ΔTS (accelerated cooling − as rolled (kg/mm²))
YS, TS (kg/mm²)
◇ : ΔYS
○ : ΔTS
300μ
70μ
115μ
220μ
60μ
105μ
180μ
130μ
65μ
95μ
slab reheating temperature (°C)
○ : TS as rolled
● : TS accelerated cooled
△ : YS as rolled
▲ : YS accelerated cooled

METHOD OF MANUFACTURING HIGH STRENGTH LOW ALLOYS STEEL PLATES WITH SUPERIOR LOW TEMPERATURE TOUGHNESS

BACKGROUND OF THE INVENTION

This invention relates to a method of manufacturing high strength low alloys steels with low temperature toughness, more particularly to a method capable of greatly improving the strength and toughness by an accelerated cooling treatment following hot rolling.

Various methods of improving the strength and toughness of high strength low alloy steels have been proposed. Among these methods, thermomechanical treatment of the low alloy steels is important in view of economy and characteristics of the products, and accelerated cooling subsequent to hot rolling of thick plates is also important. Furthermore, controlled rolling technique is widely used for the purpose of improving the strength and toughness of low alloy steels, and it has been known that the accelerated cooling subsequent to the controlled rolling is effective to further improve the strength without impairing toughness. According to these known methods, however, it has been difficult to simultaneously improve the strength and toughness by the accelerated cooling after hot rolling. Especially, when a great improvement in the strength is contemplated by the accelerated cooling treatment, it has been necessary to sacrifice the toughness.

SUMMARY OF THE INVENTION

Accordingly, it is an object of this invention to provide an improved method of manufacturing low alloys steel plates with high tensile strength and toughness characteristics.

According to this invention, there is provided a method of manufacturing high tensile steel and high toughness steel plates, characterized in that a steel slab or bloom containing 0.03~0.15% by weight of C, 0.05~0.60% by weight of Si, 0.60~2.5% by weight of Mn, 0.010~0.15% by weight of Nb, 0.005~0.10% by weight of soluble Al and the remainder of iron is heated to such a temperature region above 1050° C. and below the reheating temperature region where the austenitic grain size would be 150μ, that the heated steel slab or bloom is hot rolled with total rolling reduction of more than 40% with respect to a finished thickness at the non-recrystallized austenitic region, that the hot rolled stocks are subjected to an accelerated cooling at a rate of 5°~20° C./sec. from a temperature higher than the $Ar_3$ transformation point to a temperature within 550°~650° C., and that the stocks are air cooled.

If desired the steel slab or bloom may further contain one or more of less than 0.025% by weight of Ti, less than 0.5% by weight of Cu, less than 0.60% by weight of Mo, and less than 0.50% of Ni.

DESCRIPTION OF THE PREFERRED EMBODIMENTS

Figures 1A, 1B, 1C:
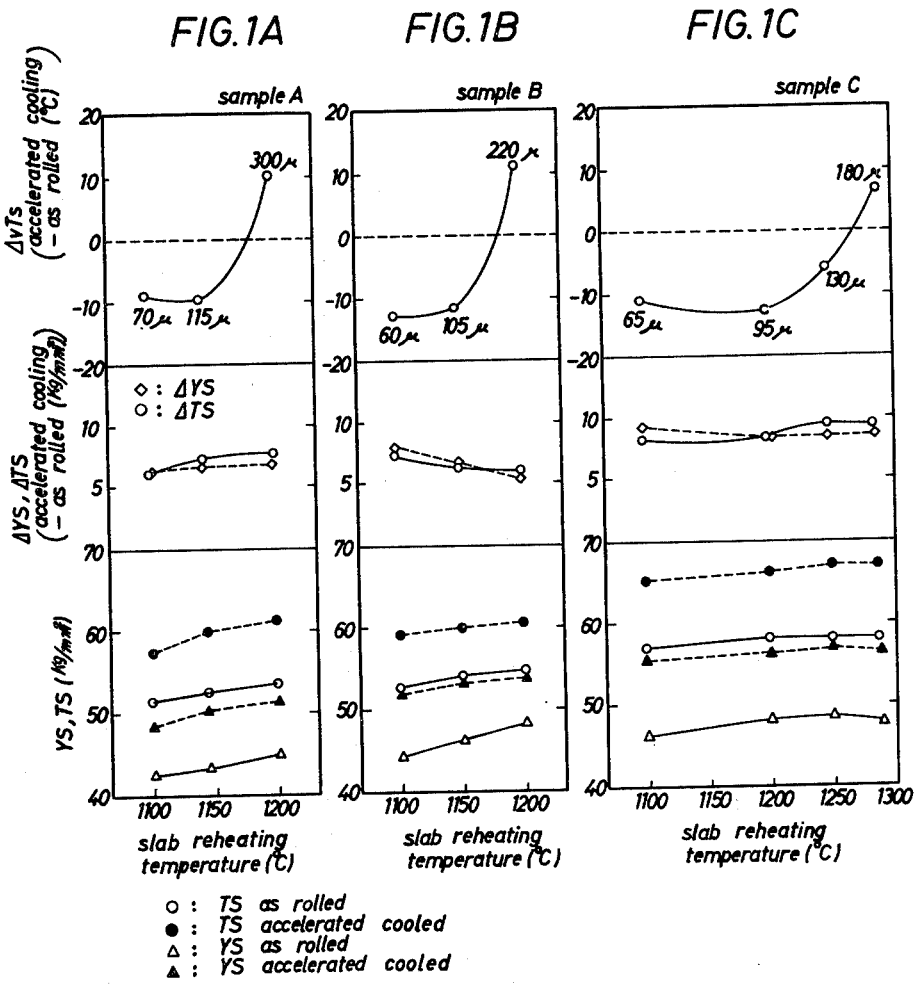
FIGS. 1A, 1B and 1C are graphs showing the relationships between the slab heating temperature, strength and toughness of as rolled stocks and stocks subjected to accelerated cooling.

As a result of our exhaustive research we have found that it is possible to simultaneously improve the strength and the toughness by accelerated cooling subsequent to hot rolling only when a special combination of heating, rolling and cooling conditions are used.

More particularly, substantial increase in the strength by accelerated cooling can be accomplished by forming a dual phase structure of extremely fine ferrite and bainite. Generally speaking, where the speed of the accelerated cooling after rolling is relatively low any radical change of the structure does not occur but the ferrite grains become more fine, thereby improving the notch toughness. In this case, however, increase in the tensile strength due to accelerated cooling is small so that it is impossible to save the alloy elements as well as carbon content to improve the weldability and to greatly increase the tensile strength. To accomplish these objects, it is necessary to radically change the microstructures from ferrite-pearlite in as rolled state to ferrite-bainite in accelerated cooling which effectively strengthens the steel. As a result of our accelerated cooling tests made on many kinds of steels, we have found that it is necessary to use accelerated cooling at a rate of at least 5° C./sec. from a temperature above $Ar_3$ transformation point for the purpose of realizing the change in the microstructure described above. According to known technique, the accelerated cooling results in a large increase in the strength and change in the structure the resulting low temperature toughness is comparable with or inferior to those of the as rolled stocks. However, when a combination of an adequate slab heating temperature and a rolling condition is used it is possible to extremely uniformly and finely disperse not only the ferrite but also the bainite structure, thus improving the strength and toughness.

The steel of this invention has the chemical composition described above and the ranges of respective elements are determined for the following reason. More particularly, C less than 0.03% by weight is not sufficient to increase the tensile strength whereas when the amount of C increases beyond 0.15% by weight the weldability would be impaired. Although the amount of Si should be higher than 0.05% by weight for effecting deoxidation but Si higher than 0.60% by weight degrades weldability and formability. Similar to C, at least 0.60% by weight of Mn is necessary to increase the tensile strength whereas Mn higher than 2.50% by weight degrades the weldability. Nb is an indispensable element to this invention, and its amount of content should be higher than 0.010% by weight for the purpose of forming non-recrystallized austenite, but when its amount exceeds 0.15% by weight, the weldability decreases. Since Al is used to deoxidize the steel, to fix N, and to refine the microstructure, its amount should be higher than 0.005% by weight in terms of acid soluble aluminum and less than 0.1% by weight for preserving clearness. Ti which forms thermally stable TiN with N in austenite, raises the temperature at which the austenite structure becomes coarse, and is effective to refine the grain size of austenite structure so that its amount should be less than 0.025% for the purpose of manifesting these desirable characteristics. Cu, Mo and Ni are effective to increase the tensile strength as they make solid solution with Fe so that the steel is hardened. Especially, Ni is useful to increase the low temperature toughness. Cu of less than 0.5%, Mo of less than 0.6% and Ni of less than 0.5%, all by weight, can accomplish their objects and these elements are incorporated singly or concurrently.

The heating temperature of the slab should be higher than 1050° C. Because at a temperature below 1050° C., Nb does not form a solid solution and the recrystallization temperature of austenite does not increases, so that it is impossible to increase the total rolling reduction in the desired non-recrystallized austenitic region and because it is impossible to enhance the precipitation hardening property caused by the accelerated cooling. Moreover, as the hardening ability decreases, fine bainite structure would not be formed, thereby failing to form a two phase mixed structure of fine ferrite and bainite which is indispensable for increasing the strength and toughness. According to this invention, the slab or bloom is reheated to a temperature higher than 1050° C. and lower than reheating temperature region which causes the austenite grain size to reach 150μ in a given reheating time such as 1 hr. Considering this relationship in more detail, the following three samples A, B and C of steel as shown in the following table 1 were prepared and the slabs were heated to the same temperature and rolled under the same condition (that is, a slab heating temperature of 1100°~1280° C. and a finishing temperature of 800° to 810° C.). One sample was rolled and then air cooled so as to obtain an as rolled stock whereas the other sample was subjected to an accelerated cooling at a rate of 8°~12° C./sec. between 790° C. and 600° C. to obtain the accelerated cooled plates.

Table 1

| type | C | Si | Mn | P | S | Mo | Nb | Ti | Sol.Al | TN |
|---|---|---|---|---|---|---|---|---|---|---|
| A | 0.09 | 0.21 | 1.33 | 0.013 | 0.007 | — | 0.019 | — | 0.017 | 0.0063 |
| B | 0.09 | 0.22 | 1.42 | 0.014 | 0.008 | — | 0.038 | — | 0.010 | 0.0060 |
| C | 0.12 | 0.25 | 1.35 | 0.018 | 0.003 | 0.13 | 0.036 | 0.017 | 0.020 | 0.0058 |

The strength and charpy fracture transition temperature of the as rolled plates and accelerated cooled plates of various types of steel were measured and the results are shown in FIG. 1. The accelerated cooled stocks of the three steel samples have a strength about 5 kg/mm$^2$~10 Kg/mm$^2$ larger than the as rolled plates irrespective of the reheating temperature. However, the low temperature toughness of the accelerated cooled plates is higher or lower than that of the as rolled plates depending upon the slab reheating temperature. From the correspondence between the austenitic grain size and the variation in the toughness which are labelled at respective measuring points shown in FIG. 1, and the relationship between the austenite grain size at respective slab reheating temperatures and the difference between the toughness of the accelerated cooled stocks and of the as rolled stocks shown in FIG. 2, it can be noted that improvement in the toughness caused by the accelerated cooling can be obtained in cases where the austenite grain size attained in reheating temperature is less than 150μ. As can be noted from the uppermost curve of FIG. 1, the toughness is generally improved by about 10° C. or more when the grain size is less than 120μ. It is also evident from these figures that the increment of strength around 5~10 kg/mm$^2$ is attained by accelerated cooling in these steels. The austenite grain size at the slab reheating temperature can be varied depending upon the heating temperature, composition, especially microalloying elements such as Al, Nb or Ti. In the samples A, B and C described above, the heating temperature at which the grain size becomes larger than 150μ varies depending upon the amounts of Nb or a small amount of Ti addition. It is presumed that this temperature is about 1170° C. for sample A, 1180° C. for sample B, and 1280° C. for sample C. From the relationship described above, it will be noted that in order to improve the toughness by accelerated cooling it is essential to use a slab reheating temperature at which the austenite grain size becomes smaller than 150μ owing to the chemical composition of steel. The importance of the austenite grain size under reheated condition was clarified by systematic research regarding the transformation structure of the accelerated cooled stock. More particularly, under a condition in which the accelerated cooling speed is higher than 5° C./sec. (in the case shown in FIG. 1, 8°~12° C./sec.) even when the total cumulative rolling reduction in the non-recrystallized region of the austenite is sufficiently high. When the austenite grain size is larger than 150μ, the transformation structure becomes a coarse bainite structure wherein initially transformed ferrite has grown along the austenite grain interfaces which extend in the direction of rolling, whereas when the grain size is less than 150μ, so long as the cumulative rolling reduction is higher than 40%, a mixed structure of extremely fine ferrite and bainite would be obtained, thereby simultaneously improving strength and toughness.

Figure 2:
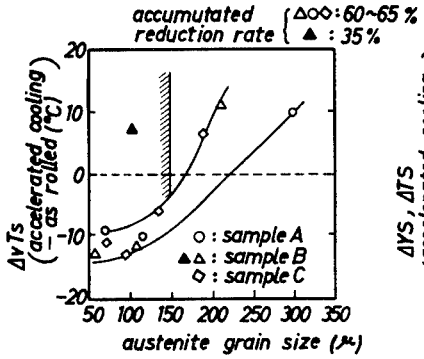
FIG. 2 is a graph showing the relationship between austenite grain size at the slab reheating temperature and toughness.

As shown in FIG. 2 and by the following embodiments, even when a slab reheating temperature which ensures austenite grain size of less than 150μ is used, where the total rolling reduction in the non-recrystallized austenite region is less than 40%, the level of the toughness itself is inferior so that it is impossible to improve the toughness by the accelerated cooling. Thus, it can be noted that it is essential to use a total cumulative rolling reduction higher than 40% in the non-recrystallized austenite region in order to obtain a mixed structure of fine bainite and ferrite. (The temperature at which austenite becomes non-recrystallized during rolling mainly depends upon the quantity of Nb, and it is about 860° C. for sample A which contains 0.02% by weight of Nb, about 900° C. for sample B which contains 0.04% by weight of Nb and also about 900° C. for sample C containing 0.036% by weight of Nb, showing that the temperature becomes higher as the content of Nb increases.)

Figure 3:
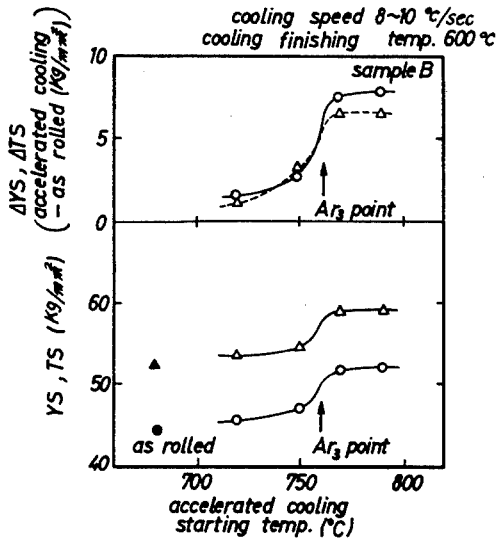
FIG. 3 is a graph showing the relationship between the starting temperature of accelerated cooling and the strength of as rolled stocks and of stocks subjected to the accelerated cooling and FIG. 4 is a graph showing the relationship between the finishing temperature of accelerated cooling and the strength.
Figure 4:
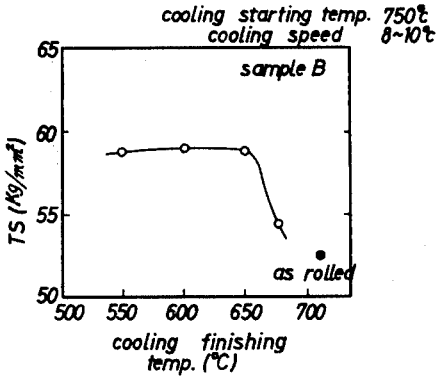

With regard to the condition of accelerated cooling, it is essential that the starting temperature of accelerated cooling should be higher than the $Ar_3$ transformation point. Thus even when the slab is hot rolled under the above described conditions of this invention, as the starting temperature of accelerated cooling becomes lower than the $Ar_3$ transformation point as shown in FIG. 3, the increase in the strength becomes lower than that of the as rolled stocks by several Kg/mm². This means that it is impossible to attain the object of this invention. (The results shown in FIG. 1 were obtained with a rolling finishing temperature of 800°~810°, and a cooling starting temperature of 790° C., and the $Ar_3$ transformation points of samples A, B and C were 750°~760° C.) Especially when the hot rolled stock is cooled from the temperature of $Ar_3$ transformation point plus 20° C., the strength thereof may increase by about 10 kg/mm². The lower limit of the cooling rate is 5° C./sec., while the upper limit is 20° C./sec. When the accelerated cooling is given at a rate higher than 20° C./sec., the toughness can not be improved, and in addition nonuniformity of the structure and hardness in the direction of the plate thickness increases. The temperature range in which the accelerated cooling has to be stopped is from 550° to 650° C. The steel of this invention has a fine ferrite-bainite structure containing more than 5% of fine and uniformly dispersed bainite structure. By stopping the accelerated cooling in this range, an autotempering effect occurs during subsequent air cooling, thereby simultaneously improving the strength and the toughness. Precipitation of Nb and V occurs most effectively at said stop temperature. However, if the steel stock is continuously cooled to a temperature below 550° C. and then air cooled, sufficient precipitation does not occur during the cooling, whereas when the cooling is stopped at a temperature higher than 650° C., the increment of strength due to accelerated cooling decreases rapidly as shown in FIG. 4, in which case the amount of bainite becomes less than 5%, meaning that the object of this invention can not be attained.

As shown in FIG. 1, the accelerated cooling decreases the toughness in one case but increases it in the other case depending on reheating temperature. The amounts of N in the state of solid solution at the higher or lower temperature than these critical reheating temperatures are 0.0058% by weight and 0.0053% by weight at 1200° C. and 1150° C., respectively for sample A, 0.0052% by weight and 0.0046% by weight respectively at the same temperatures for sample B, and 0.0027% by weight and 0.0021% by weight at 1280° C., and 1250° C., respectively for sample C. These data show that the steel of this invention is not influenced by the amount of N. In the embodiments to be described later, steel H and I are samples containing different amounts of N, but as can be noted from the characteristics of these samples, the method of this invention can produce steel plates having excellent toughness property even when the content of N is relatively high.

To have better understanding of the invention the following examples are given, but it should be understood that the invention is not limited to these specific examples.

EXAMPLE 1

Steel samples A, B and C having compositions shown in Table 1 were heated to a temperature of 1100° through 1250° C., and the mechanical characteristics of as rolled stocks and of the stocks which were subjected to accelerated cooling after rolling were measured. The mechanical properties in all the examples were investigated in the specimens taken from the transverse direction of rolling. Furthermore, the strength and the toughness of the as rolled stocks and the accelerated cooled stocks which were rolled under the same conditions were also measured. The results of measurements are shown in the following Table 2.

Table 2

| Sample | o this invention x comparison | slab heating temp. (°C.) | austenite grain size at the slab reheating temperature (μ) | total rolling reduction (%) in non-recrystallized region | accelerated cooling speed (°C./sec.) |
|---|---|---|---|---|---|
| A-1 | x | 1200 | 300 | 65 | as rolled |
| 2 | x | " | " | " | 12.3 |
| 3 | x | 1140 | 115 | 65 | as rolled |
| 4 | o | " | " | " | 11.5 |
| 5 | x | 1100 | 70 | 65 | as rolled |
| 6 | o | " | " | " | 8.6 |
| B-1 | x | 1200 | 220 | 60 | as rolled |
| 2 | x | " | " | " | 10.9 |
| 3 | x | 1150 | 105 | 60 | as rolled |
| 4 | o | " | " | " | 8.5 |
| 5 | x | " | " | " | 2.3 |
| 6 | x | 1150 | 105 | 35 | as rolled |
| 7 | x | " | " | " | 12.8 |
| 8 | x | 1100 | 63 | 60 | as rolled |
| 9 | o | " | " | " | 9.8 |
| C-1 | x | 1250 | 130 | 65 | as rolled |
| 2 | o | " | " | " | 9.8 |
| 3 | x | 1200 | 95 | 65 | as rolled |
| 4 | o | " | " | " | 12.5 |
| 5 | x | " | " | " | 23.5 |
| 6 | x | 1100 | 65 | 65 | as rolled |
| 7 | o | " | " | " | 11.5 |
| 8 | x | 1000 | 44 | 65 | as rolled |
| 9 | x | " | " | " | 10.6 |

| | tensile test | | | 2V Charpy test | | |
|---|---|---|---|---|---|---|
| Sample | yield strength (YS) (Kg/mm²) | tensile strength (TS) (Kg/mm²) | ΔYS (Kg/mm²) | energy at 0° C. (vEo) (Kg-m) | vTs (°C.) | ΔvTs (°C.) |
| A-1 | 45.1 | 53.9 | — | 12.8 | −64 | — |
| 2 | 51.9 | 61.7 | 6.8 | 10.3 | −54 | 10 |
| 3 | 43.5 | 52.5 | — | 12.5 | −75 | — |
| 4 | 50.0 | 59.8 | 7.1 | 11.0 | −85 | 10 |
| 5 | 42.8 | 51.7 | — | 12.2 | −83 | — |
| 6 | 48.6 | 57.4 | 5.8 | 10.9 | −92 | −9 |
| B-1 | 48.4 | 54.5 | — | 12.2 | −76 | — |
| 2 | 53.8 | 60.5 | 5.4 | 9.6 | −64 | 12 |
| 3 | 46.4 | 53.5 | — | 12.5 | −83 | — |
| 4 | 53.0 | 59.9 | 6.6 | 12.1 | −95 | −12 |
| 5 | 47.6 | 54.4 | 1.8 | 12.7 | −87 | −4 |
| 6 | 45.8 | 53.0 | — | 13.2 | −70 | — |
| 7 | 53.0 | 60.1 | 7.2 | 11.5 | −63 | 7 |
| 8 | 44.3 | 52.5 | — | 13.0 | −74 | — |
| 9 | 52.1 | 59.0 | 7.8 | 10.8 | −107 | −13 |
| C-1 | 48.5 | 58.0 | — | 17.2 | −60 | — |
| 2 | 57.1 | 67.2 | 8.6 | 15.8 | −66 | −6 |
| 3 | 48.0 | 57.8 | — | 16.3 | −85 | — |
| 4 | 56.4 | 66.2 | 8.4 | 15.6 | −99 | 13 |
| 5 | 59.1 | 80.2 | 11.1 | 7.9 | −65 | 20 |
| 6 | 46.5 | 57.2 | — | 16.1 | −118 | — |
| 7 | 55.8 | 65.3 | 9.3 | 14.7 | −129 | −11 |
| 8 | 42.7 | 52.3 | — | 17.2 | −123 | — |
| 9 | 49.4 | 53.5 | 1.7 | 16.4 | −139 | −8 |

Most of the data in Table 2 are shown in FIG. 1. As has already been pointed out, it is essential to limit the austenite grain size below 150μ for the purpose of greatly improving the tensile strength and low temperature toughness where the total rolling reduction in non-recrystallized austenitic region is high, that is 60~65%. Thus, in the samples A-1 and B-2, since the grain size is larger than 150μ, it is impossible to obtain high toughness. In sample B-5, the grain size is 150μ and the total rolling reduction is 60%, which are within the ranges of this invention. However, the accelerated cooling speed is 2.3° C./sec. which is lower than 5° C./sec., and therefore the increase in the strength is only 2 Kg/mm$^2$, thus failing to increase the strength. In sample C, the cooling speed is 23.5° C./sec. which is above the range of this invention. In this case, although the tensile strength increases greatly, the value of vTs is higher than that of the as rolled stock by 20° C. so that the toughness decreases. In this manner, irrespective of the steel species it is essential to use a cooling speed of 5°~20° C./sec. in order to greatly increase both the tensile strength and the toughness. In sample B-7, although the heating condition and the accelerated cooling conditions are within the ranges of this invention, the total rolling reduction in the non-recrystallized austenitic region is 35%, that is lower than 40%. At this time, since coarse bainite is formed, the tensile strength is increased but the toughness is lowered. This shows the reason for limiting the total rolling reduction. In Sample C-9, the heating temperature is 1000° C. which is lower than 1050° C. of this invention. Although, in this case, the toughness is higher than the as rolled stock, the increase in the strength is small.

EXAMPLE 2

Samples of steel, D, E, F and G having the chemical compositions as shown in the following Table 3 were prepared.

Table 3

| Sample | C | Si | Mn | P | S | Mo | Nb | V | Ni | Sol . Al | TN |
|---|---|---|---|---|---|---|---|---|---|---|---|
| D | 0.10 | 0.30 | 1.50 | 0.008 | 0.006 | — | 0.036 | 0.08 | 0.23 | 0.032 | 0.0062 |
| E | 0.05 | 0.17 | 1.77 | 0.012 | 0.009 | 0.16 | 0.033 | — | — | 0.011 | 0.0065 |
| F | 0.06 | 0.24 | 2.12 | 0.006 | 0.006 | — | 0.056 | — | 0.25 | 0.015 | 0.0061 |
| G | 0.06 | 0.25 | 1.53 | 0.009 | 0.008 | 0.48 | 0.052 | — | 0.27 | 0.022 | 0.0087 |

The mechanical characteristics of the as rolled stocks and accelerated cooled stocks of these samples which were prepared under various heating conditions and rolling conditions were measured. The strength and the toughness of the accelerated cooled stocks and of the as rolled stocks were also measured, and the results are shown in the following Table 4. The accelerated cooling was started at 790°~780° C. and stopped at 600° C., which are within the ranges of this invention.

Table 4

| Sample | o this invention x comparison | slab reheating temp. (°C.) | austenite grain size at the slab reheating temp. (μ) | total rolling reduction (%) in non-recrystallized region | accelerated cooling speed (°C./sec.) |
|---|---|---|---|---|---|
| D-1 | x | 1250 | 360 | 70 | as rolled |
| 2 | x | " | " | " | 4.2 |
| 3 | x | 1100 | 55 | 70 | as rolled |
| 4 | o | " | " | " | 11.9 |
| 5 | o | " | " | " | 16.5 |
| 6 | x | " | " | " | 3.8 |
| E-1 | x | 1140 | 125 | 60 | as rolled |
| 2 | o | " | " | " | 6.2 |
| 3 | o | " | " | " | 15.6 |
| F-1 | x | 1200 | 230 | 67 | 9.8 |
| 2 | o | 1150 | 95 | " | 10.2 |
| 3 | o | " | " | " | 12.4 |
| 4 | o | 1100 | 56 | " | 10.5 |
| G-1 | x | 1150 | 104 | 65 | as rolled |
| 2 | o | " | " | " | 6.4 |
| 3 | o | " | " | " | 12.9 |
| 4 | x | 1080 | 52 | 65 | as rolled |
| 5 | o | " | " | " | 10.3 |
| 6 | x | 1080 | 52 | 30 | as rolled |
| 7 | x | " | " | " | 11.4 |
| 8 | x | 1000 | 35 | 65 | as rolled |
| 9 | x | " | " | " | 11.6 |

| | tensile test | | | | 2V Charpy test | | |
|---|---|---|---|---|---|---|---|
| Sample | YS (Kg/mm$^2$) | TS (Kg/mm$^2$) | ΔYS (Kg/mm$^2$) | ΔTS (Kg/mm$^2$) | vEo (Kg-m) | vTs (°C.) | ΔvTs (°C.) |
| D-1 | 51.7 | 61.2 | — | — | 10.1 | −73 | — |
| 2 | 59.3 | 71.9 | 7.6 | 10.7 | 8.4 | −64 | 9 |
| 3 | 50.7 | 7.2 | — | — | 9.2 | −114 | — |
| 4 | 58.8 | 68.9 | 7.9 | 9.7 | 7.2 | −125 | −11 |
| 5 | 52.9 | 72.5 | 12.2 | 13.3 | 6.8 | −121 | −7 |
| 6 | 62.7 | 61.0 | 2.0 | 1.8 | 8.8 | −115 | −1 |
| E-1 | 40.6 | 55.4 | — | — | 12.4 | −94 | — |
| 2 | 45.6 | 60.5 | 5.0 | 5.1 | 13.7 | −110 | −16 |
| 3 | 50.3 | 63.5 | 9.7 | 8.1 | 12.5 | −108 | −14 |
| F-1 | 57.1* | 73.2 | 5.9 | 7.3 | 9.6 | −75 | — |
| 2 | 55.6* | 73.6 | 6.5 | 7.8 | 9.7 | −132 | −18 |
| 3 | 56.3* | 74.3 | 5.2 | 8.5 | 9.6 | −128 | −14 |
| 4 | 59.8* | 66.5 | 2.4 | 6.0 | 10.6 | −135 | −25 |
| G-1 | 43.1* | 66.0 | — | — | 8.0 | −103 | — |
| 2 | 48.7* | 73.6 | 4.8 | 7.6 | 8.0 | −115 | −12 |
| 3 | 51.7 | 77.0 | 7.8 | 11.0 | 7.8 | −116 | −13 |
| 4 | 42.3 | 62.6 | — | — | 9.2 | −114 | — |
| 5 | 52.9* | 79.1 | 10.6 | 6.5 | 7.6 | −150 | −36 |

Table 4-continued

| | | | | | | | |
|---|---|---|---|---|---|---|---|
| 6 | 41.6 | 62.2 | — | — | 9.0 | −81 | — |
| 7 | 48.8* | 71.3 | 7.2 | 9.1 | 7.2 | −70 | 11 |
| 8 | 40.3 | 58.1 | — | — | 8.7 | −118 | — |
| 9 | 42.5 | 59.8 | 2.2 | 1.7 | 8.1 | −136 | −18 |

Remark
*shows 0.2% offset flow stress and other data in column
YS show lower yielding strength.

The heating condition, the rolling condition and the cooling condition of samples D-4, D-5, E-2, E-3, F-2, F-3, F-4, G-2, G-3 and G-5 are within the ranges of this invention, and the variations in the strength and toughness of the accelerated cooled plates compared with as rolled plates show that the strength has increased several Kg/mm² while vTs has decreased 10° C. or more. These data show that the method of this invention can produce steel plates having excellent tensile strength and high toughness.

On the other hand, the austenite grain size under heated condition of the samples D-2 and F-1 is larger than 150μ showing that only the tensile strength increases but the toughness decreases even though the rolling condition and the cooling condition are satisfied. In sample D-6, the cooling speed is low so that although the toughness is equal or higher than that of the as rolled stock, the increase in the strength is small, that is less than several Kg/mm², thus decreasing the advantage of the accelerated cooling. The total rolling reduction in the non-recrystallized austenitic region of sample G-7 is less than 40% which is below the range specified by the invention. In this case, although the tensile strength increases, the toughness becomes poor greatly for the reason described above. In sample G-9 the reheating temperature is 1000° C. which is lower than 1050° C. Consequently, even when all other conditions are fulfilled, due to the decrease in the amount of Nb in the state of a solid solution, the ability of hardening decreases so that fine bainite would not form. Moreover, as the effect of precipitation, hardening due to the accelerated cooling does not increase so that increase in the strength is smaller.

EXAMPLE 3

Two samples H and I containing different amounts of N as shown in the following Table 5 were prepared.

Table 5

| Sample | C | Si | Mn | P | S | Mo | Nb | Sol.Al | T.N |
|---|---|---|---|---|---|---|---|---|---|
| H | 0.09 | 0.26 | 1.44 | 0.012 | 0.007 | 0.14 | 0.024 | 0.033 | 0.0021 |
| I | 0.09 | 0.28 | 1.48 | 0.015 | 0.007 | 0.15 | 0.027 | 0.017 | 0.0059 |

These samples were heated at temperatures shown in the following Table 6, rolled with total rolling reduction of 55% in non-crystallized austenitic region, finished to 20 mm at 800° C., then air cooled after rolling or accelerated cooled to 600° C. to obtain products. The characteristics of the products are shown on the right-hand half of Table 6.

Table 6

| Sample | o this invention x comparison | slab reheating temp. (°C.) | austenite grain size at the slab reheating temp. (μ) | accelerated cooling speed (°C./sec.) | tensile test: yielding strength (YS) (Kg/mm²) | tensile test: tensile strength (TS) (Kg/mm²) | tensile test: ΔYS (Kg/mm²) | 2V Charpy test: vTs (°C.) | 2V Charpy test: ΔvTs (°C.) |
|---|---|---|---|---|---|---|---|---|---|
| H-1 | x | 1200 | 290 | as rolled | 45.2 | 59.5 | — | −61 | — |
| 2 | x | " | " | 9.2 | 50.9 | 67.4 | 5.7 | −53 | 8 |
| 3 | x | 1100 | 65 | as rolled | 43.1 | 58.1 | — | −76 | — |
| 4 | o | " | " | 7.1 | 49.7 | 68.4 | 6.6 | −90 | −14 |
| I-1 | x | 1200 | 260 | as rolled | 44.1 | 59.3 | — | −63 | — |
| 2 | x | " | " | 8.8 | 50.2 | 66.9 | 6.1 | −56 | 7 |
| 3 | x | 1100 | 64 | as rolled | 41.0 | 57.8 | — | −82 | — |
| 4 | o | " | " | 8.3 | 48.8 | 64.6 | 7.8 | −99 | −17 |

In these two samples, when their slabs were heated at 1200° C. at which the austenite grain size becomes larger than 150μ, the accelerated cooling increases the tensile strength but does not improve the toughness. On the other hand, where the austenite grain size is smaller than 150μ, the method of this invention greatly increases the tensile strength and improves the toughness than that of the as rolled stocks regardless of the steel species, thus producing high quality steel plates.

As above described the method of this invention can produce steel plates having a tensile strength larger than that of as rolled stocks by several Kg/mm² and an improved low temperature toughness characteristic.

What is claimed is:

1. A method of manufacturing high tensile strength and high toughness steel plates comprising the steps of reheating a steel slab or bloom comprising containing 0.03~0.15% by weight of C, 0.04~0.60% by weight of Si, 0.60~2.5% by weight of Mn, 0.010~0.15% by weight of Nb, 0.005~0.10% by weight of soluble Al and the remainder iron to a temperature above 1050° C. and below the reheating temperature at which the austenite grain size would be 150μ or higher, hot rolling the heated steel slab or bloom in the temperature range between the temperature at which recrystallization of the austenite grains begins and the $Ar_3$ transformation point temperature sufficient to obtain a total reduction by said rolling of more than 40% with reference to the finished thickness, acceleratedly cooling said hot rolled steel at a rate of 5°~20° C./sec. from a temperature higher than $Ar_3$ transformation point to a temperature within 550°~650° C., and then air cooling said hot rolled steel.

2. The method according to claim 1 wherein said steel slab or bloom also contains at least one of less than 0.025% by weight of Ti, less than 0.50% by weight of Cu, less than 0.60% by weight of Mo, and less than 0.50% by weight of Ni.

3. The method according to claim 1 wherein said reheating temperature is such that the austenite grain size is smaller than 120μ.

4. The method according to claim 1 wherein said hot rolled steel is cooled from a temperature higher than $Ar_3$ transformation point plus 20° C.

5. The method according to claim 3 wherein said hot rolled steel is cooled from a temperature higher than $Ar_3$ transformation point plus 20° C.

6. An improved steel having high tensile strength and high toughness characteristics having a two-phase microstructure of fine ferrite and bainite consisting essentially of between 0.03 and 0.15% by weight carbon, 0.05 and 0.60% by weight silicon, 0.60 and 2.5% by weight manganese, 0.1 and 0.15% by weight niobium, 0.005 and 0.10% by weight soluble aluminum, and the remainder essentially iron, produced in accordance with the method of claim 1.

7. The steel of claim 6, which also contains at least one element selected from the group consisting of titanium in an amount less than 0.025% by weight, copper in an amount less than 0.50% by weight, molybdenum in an amount less than 0.60% by weight, and nickel in an amount less than 0.50% by weight.

* * * * *